US005402903A

United States Patent [19]

Mann

[11] Patent Number: 5,402,903

[45] Date of Patent: Apr. 4, 1995

[54] SMALL CONTAINERS WITH A PLUG-IN CONNECTION

[75] Inventor: Horst Mann, Babenhausen, Germany

[73] Assignee: Ferrero OH GmbH, Frankfurt am Main, Germany

[21] Appl. No.: 984,585

[22] PCT Filed: Jun. 9, 1992

[86] PCT No.: PCT/EP92/01285

§ 371 Date: Mar. 9, 1993

§ 102(e) Date: Mar. 9, 1993

[87] PCT Pub. No.: WO92/22476

PCT Pub. Date: Dec. 23, 1992

[30] Foreign Application Priority Data

Jun. 11, 1991 [DE] Germany ..... 41 19 252.4

[51] Int. Cl.[6] ..... B65D 21/00

[52] U.S. Cl. ..... 220/23.6; 220/23.86

[58] Field of Search ..... 220/23.86, 23.83, 23.4, 220/23.6

[56] References Cited

U.S. PATENT DOCUMENTS 2,144,751 3/1937 Brown .
4,624,383 11/1986 Moore .
4,844,263 7/1989 Hadtke .
4,905,833 3/1990 Kreeger et al. .

FOREIGN PATENT DOCUMENTS 0792237 3/1973 Belgium .
2537096 4/1984 France .
7214476 4/1972 Germany .
7711879 4/1977 Germany .
8622192 4/1986 Germany .
1499603 2/1978 United Kingdom .
2196319 9/1986 United Kingdom .
WO8607335 12/1986 WIPO .

*Primary Examiner*—Jodeph Man-fu Moy
*Attorney, Agent, or Firm*—Sughrue, Mion, Zinn, Macpeak & Seas

[57] ABSTRACT

A small container includes two hollow plastic parts detachably interconnected together. Each part includes substantially cylindrical side walls and opposite end walls which are disposed perpendicular to a longitudinal axis of the container. Rounded connecting portions are provided between the end walls and the side walls. A projection is provided on one end surface and a complementary recess is provided on an opposite end surface whereby a plurality of containers may be interconnected end-to-end. A plurality of ribs extending in the longitudinal direction of the container alternate with a plurality of grooves continuously about the entire periphery of the container whereby a plurality of containers may be laterally interconnected together by sliding the rib of one container into a groove of another container.

5 Claims, 3 Drawing Sheets

SMALL CONTAINERS WITH A PLUG-IN CONNECTION

BACKGROUND

The invention relates to a small container consisting of a moulding, especially of plastic, with an upper part and a lower part which are separable for the insertion of objects, end surfaces arranged perpendicularly to its longitudinal axis, one of which has a projection and the other a recess into which the projection of the one end surface can be introduced to produce a releasable connection, and connecting means on the periphery of at least one of the parts of the moulding. Such small containers are used as contents of hollow bodies, for example chocolate eggs, and contain objects such as toy parts. Such small containers can also include so-called surprise articles.

Such a small container is known from GB 14 99 603 A. In this, holes are provided in the wall in one of the end surfaces and on the periphery of the small container, and a mushroom-like lug is provided on the other end surface, which enable a plug-in connection of the containers, but only in a limited number of directions and positions.

A small container consisting of a lower and upper part is also disclosed in DE 86 22 192 U and has projections on the essentially cylindrical body by means of which a plug-in connection between the respectively matched projections of several small containers can be made. In this manner, an elongated body is created, although the use thereof is very limited.

It is also possible to separate such a small container in the middle and to connect the ensuing upper and lower parts in reverse by means of mutually conforming projections.

The described combination possibilities with the small container do not, however, suffice for use as a toy, as respectively only one part or oblong body or one such body with axes extending exclusively at right angles to one another can be formed.

SUMMARY OF THE INVENTION

The invention is therefore based on the object to improve small containers of the type initially described in such a manner that a plurality of combinations is possible and that the small container can be used as a toy in a variety of ways.

This object is solved in accordance with the invention by a small container of the type initially mentioned in that a projection is provided on one of the end surfaces which includes the recess for receiving the projection of the other one of the end surfaces, and that alternating hollows and protrusions are provided on the periphery of at least one of the parts of the moulding by means of which a slide-in or plug-in connection can be produced at the periphery of respectively different mouldings by the engagement of at least one protrusion with at least one hollow.

The object is also solved by means of a small container consisting of a hollow plastic moulding having a upper and lower part which are separable for the insertion of objects, the moulding having slide-in or plug-in connection possibilities in several dimensions for use as a plug-in piece of a plug-in building block toy.

Further embodiments and advantageous examples of the invention are given in the dependent claims.

It is particularly advantageous if the projection on the one end face is formed with a circular recess and the projection on the other end face is formed to be button-like for plugging into the recess of the projection in the one end face.

Alternatively, the small container can be designed in such a way that the projection in the one end face is formed of hook members arranged on a circle with radially inwardly directed hook ends and the projection in the other end face is formed to be of a circular bowl-like shape with radially outwardly directed hook members for plugging into the recess of the projection in the other end face and for bayonet-closure-like rotation into the connection position.

A particular embodiment or development of the invention consists in that the outer form of the container is changed by plugging additional parts into the hollows, the additional parts being transportable inside the container and the toy, in particular a figure or model, being produced by plugging in the additional parts.

An advantage of the inventive small container lies in that the container can be combined in the most varying directions or dimensions so that diverse forms and constructions can be formed. A further advantage lies in that a stable and releasable connection between several containers is possible. It is also advantageous that food stuffs such as chocolate and parts such as toys can be separated from one another by means of the small container. In this case, the small container does not subsequently become refuse, as it can continue to be used as a toy or building block system. A contribution is therefore made in protecting natural resources and the environment. The structure of several plugged together small containers becomes very stable on account of the plurality of engagements of the plug-in connections.

BRIEF DESCRIPTION OF THE DRAWINGS

The invention is described in more detail in the following on the basis of examplified embodiments and the drawings, in which.

DETAILED DESCRIPTION OF THE INVENTION

Figure 1:
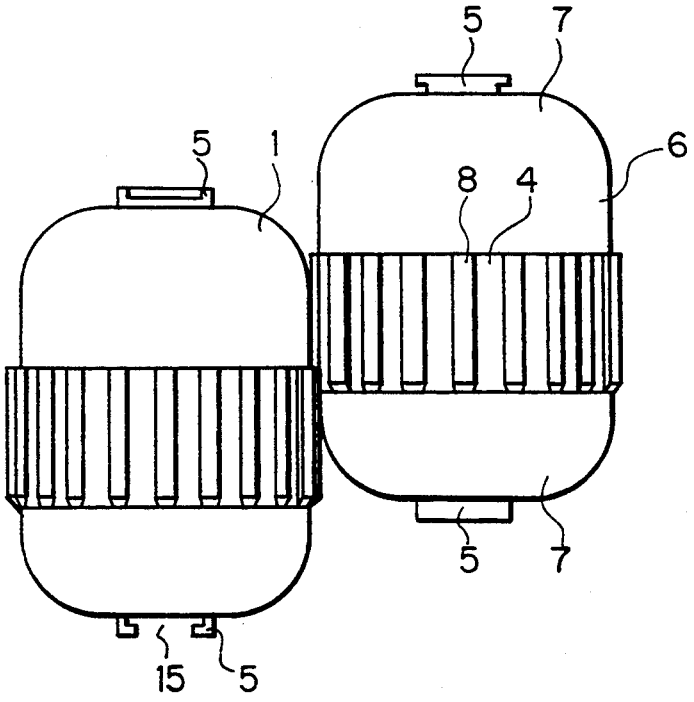
FIG. 1 shows a side view of two small containers of a first embodiment during the plugging-in procedure.
Figure 3:
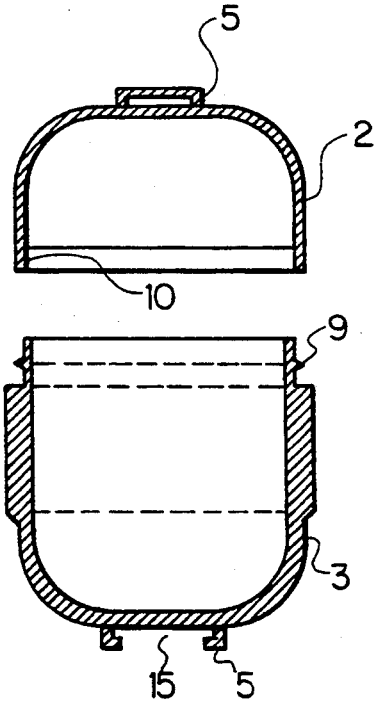
FIG. 3 shows a sectional side elevation of the small container according to FIG. 1.
Figure 2:
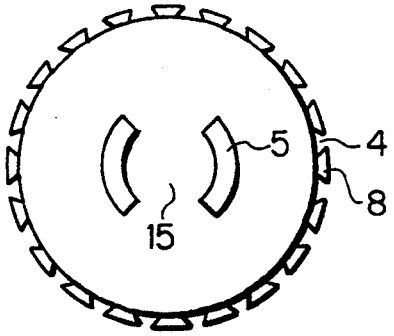
FIG. 2 shows a plan view of a small container of the first embodiment.

FIG. 1 shows the procedure of sliding together the slide-in or plug-in connections of two small containers according to a first embodiment. The small containers are substantially cylindrical and have rounded ends at the end of the longitudinal side which transit into flattened end surfaces 7. The shell surfaces 6 are cylindrical. In FIG. 2 and FIG. 3, the same embodiment is shown in plan view and in section. The small containers have a lid-like upper part 2 and a lower part 3. The lower part 3 has a drawn-in rim over which the lid 2 can be placed. For locking, the drawn-in rim is provided with a bead 9. The lid 2 has a groove 10 matching the bead 9. In sliding the upper part 2 onto the lower part 3, the annular bead 9 fits into the annular groove 10 so that a locking is achieved.

A projection 5 provided on the end surface 7 of the lower part 3 consists of hook members provided on a circle with radially inwardly directed hook ends. The hook members surround a recess 15. The end surface 7 of the upper part 2 is provided with a corresponding projection 5 which is formed in a circular bowl-like manner with radially outwardly directed hook members for plugging into the recess 15 and for bayonet-like-locking rotation into the connecting position.

The periphery of the lower part 3 is thickened at the central portion of the shell surface 6. Hollows 4 are provided in this thickened region. These hollows serve to provide the slide-in connection. Several hollows 4 are equidistantly spaced continuously around the periphery of the container 1.

Figure 8:
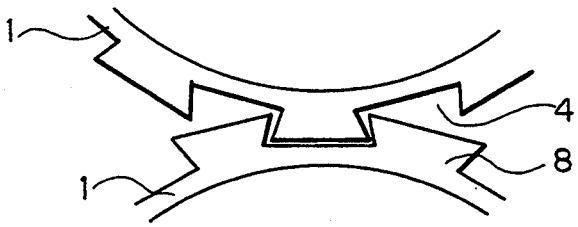
FIG. 8 shows a depiction of the principle of engagement of a slide-in or plug-in connection variation according to an embodiment of the invention.

In FIG. 8, the operational principle of the slide-in connection is shown for clarity. A protrusion 8 of one container 1 provided respectively between two hollows 4 can be fitted into a hollow 4 of a further container 1. The protrusions 8 and hollows 4 are dovetailed, i.e. provided with inclined walls in such a manner that the hollow 4 widens towards the base and the protrusion 8 tapers towards the base. By sliding-in, a dovetail connection is produced by which both parts are securely joined together. In order for the connection to be slidable or releasable, the thickening is provided with the hollows 4 and protrusions 8 only in an annular partial region of the shell surface 6 so that an open end of the hollows 4 is provided.

The ends of the protrusions 8 are chamfered or rounded-off so that the sliding-in action can be carried out more easily.

It is also possible to provide right-angled protrusions or hollows in which locking is achieved by friction. In both cases, however, a release or plugging-in of the connection is possible with the application of a certain force if a resilient material such as plastic is used for the small container.

The individual small containers may be pushed together in various directions in rows or in differently connected shapes, such as a triangle.

Figure 4:
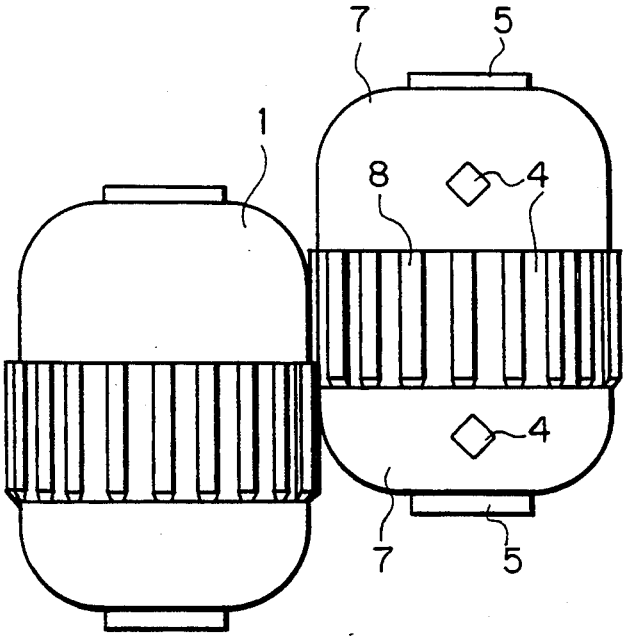
FIG. 4 shows a side view of two small containers of a second and third embodiment.
Figure 6:
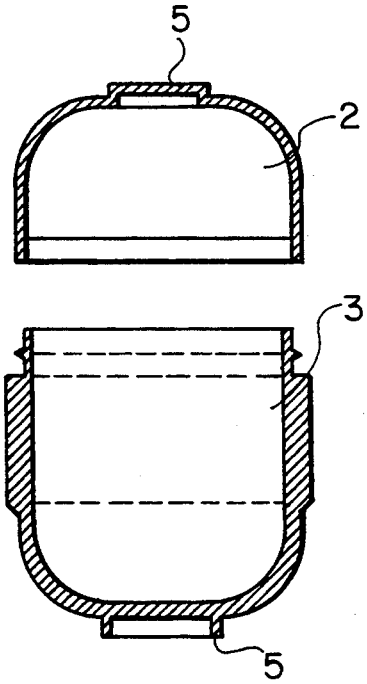
FIG. 6 shows a sectional side elevation of the small container of the second embodiment according to FIG. 4.
Figure 5:
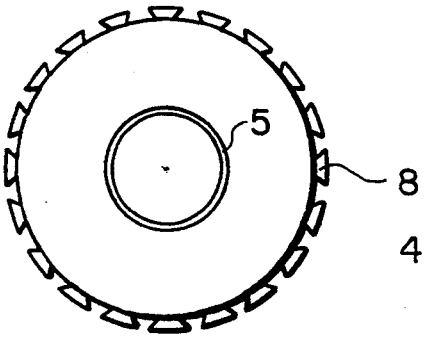
FIG. 5 shows a plan view of the small container of the second embodiment according to FIG. 4.

In FIG. 4 to FIG. 6, a further embodiment of the invention is shown in which matched projections 5 are provided on the end surfaces 7. Thus, for example, in FIG. 6, a projection 5 is provided on the upper part 2 in which a button-like recess is formed in the end surface 7. On the other hand, the lower part 3 has a projection 5 which consists of a rim or ring with a circular recess 15 which is bigger than the projection 5 of the upper part 2. The upper part 2 can thus be connected to the lower part 3. However, it is also possible in the closed state, i.e. after placing the lid 2 onto the lower part 3 and engaging the bead 9 in the groove 10, to connect several similar small containers together. In this case, a projection 5 is respectively inserted into the respectively matching projection 5 of another small container. Additionally, the slide-in connection as shown in FIG. 1 is provided. In this manner, many small containers can be combined with one another into complicated forms, connections in the direction of the longitudinal axis and in the transverse directions being possible.

It is also possible to insert other types of formed parts into the hollows 4. This is especially useful if the contents of the small container consists of further additional toy parts. These additional parts can, for example, be in the form of wings, legs, faces and so on, such that a model, a figure or other toy can be produced by means of plugging-in or sliding-in. For this purpose, further hollows 4 in the form of holes are also provided in a third embodiment into which further additional parts can be inserted. These holes can also be provided at the end surfaces 7. By providing the holes with a square or oblong shape, directional stability of the additional parts is achieved.

Figure 7:
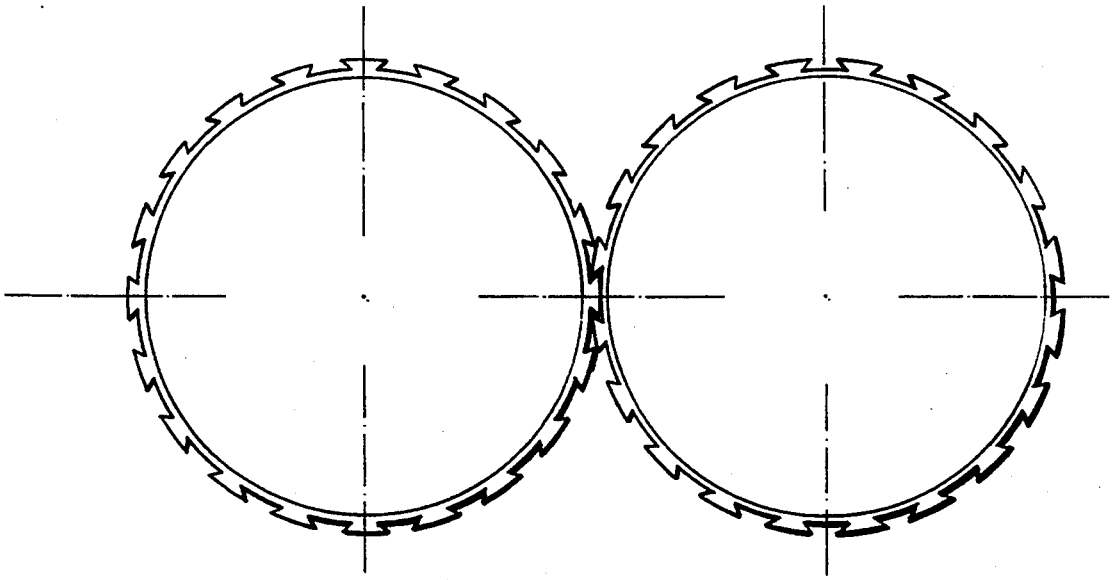
FIG. 7 shows a plan view of two small containers in engagement with one another.

In FIG. 7, a view showing the principle of engagement of a sliding connection is shown. Connection is possible at various locations and angles about the periphery of the small container.

The small container can be approx. 4 to 6 cm long and have a diameter of approximately 2.5 to 3.5 cm. As material plastic is especially suitable, for example polypropylene or ABS. The walls are approximately 0.6 to 1.0 mm thick. The projection 5 also consists of thin-walled wall sections with a thickness of 0.4 to 0.6 mm. In the region of the hollows 4 and protrusions 8, the wall thickness is increased and is approximately 2 mm. In the depicted embodiments, the upper and lower parts 2, 3 form a flush shell surface after connection. The projections 5 as well as the separating locations between the upper and lower part are flat and formed as support surfaces. Various changes and modifications are possible. For example, the small container can have a rectangular, square or polygonal form instead of the depicted round, cylindrical form. Furthermore, the projections 5 can also be polygonal or round. The slide-in connection with the hollows 4 and protrusions 8 can be provided on the entire periphery of the container or be limited to certain regions.

The dimensions of the container can also be enlarged so that other applications such as the storage of writing or kitchen utensils or the retaining of liquids are possible.

What is claimed is:

1. A small hollow container comprised of a hollow plastic moulding having substantially cylindrical side walls, end walls disposed perpendicularly to a longitudinal axis of the container and rounded-off sections connecting said side walls and end walls, said container including an upper part and a lower part detachably connected and which are separable for insertion of objects, a projection on one of said end walls and a recess on another of said end walls into which the projection on said one end wall can be inserted to produce a releasable connection, and connecting means on the side walls of at least one of said parts, wherein said connecting means is comprised of a plurality of ribs extending in the longitudinal direction of the container alternating with a plurality of grooves continuous about the entire periphery of at least one part of the container by means of which a slide-in connection is provided at various positions on the periphery of different containers by engagement of at least one rib on one container in at least one groove or another container;

wherein said recess is contained in a projection on said another of said end walls for receiving said projection on said one of said end walls, and wherein the projection on said another of said end walls is formed by hook members arranged on a circle with radially inwardly directed hook ends and the projection on said one of said end walls is formed with a circular-bowl shape with radially outwardly directed hook members for insertion into the recess of the projection on said another of said end walls to provide a bayonet-like closure upon rotation into a connection position.

2. A small container according to claim 1, wherein said upper and lower parts are connected by means of a lap-joint with a rim of one part being provided with a bead which is adapted to be received in a recess on an inner side of another part.

3. A small container according to claim 1, wherein the projection on said another of said end walls is formed as an annular projection with a central circular recess and the projection on said one of said end walls is formed as an button-like projection for insertion into the recess of the annular projection on said another of said end walls.

4. A small container according to claim 1, wherein at least one open end of said grooves between said ribs extending in the longitudinal direction of the container is provided, said grooves broaden towards their base and said ribs taper inwardly towards their base, and the slide-in connection is produced by sliding at least respectively one rib into respectively one groove from the open end.

5. A small container according to claim 4, wherein said ribs are rounded-off towards the open end.

* * * * *